United States Patent [19]

Vollrath

[11] 4,089,518

[45] May 16, 1978

[54] SHEET-HANDLING APPARATUS

[75] Inventor: Karl-Hans Vollrath, Leipzig, Germany

[73] Assignee: VEB Polygraph Leipzig Kombinat fur Polygraphische Maschinen und Ausrustungen, Leipzig, Germany

[21] Appl. No.: 805,392

[22] Filed: Jun. 10, 1977

Related U.S. Application Data

[63] Continuation-in-part of Ser. No. 771,797, Feb. 24, 1977, abandoned.

[30] Foreign Application Priority Data

Feb. 24, 1976 Germany ..... 6519143

[51] Int. Cl.[2] ..... B65H 3/34

[52] U.S. Cl. ..... 271/167; 271/98

[58] Field of Search ..... 271/97, 98, 220, 152–156, 271/123, 167, 103, 108, 31

[56] References Cited

U.S. PATENT DOCUMENTS

| | | | |
|---|---|---|---|
| 2,746,753 | 5/1956 | Battery | 271/31 |
| 2,995,359 | 8/1961 | Gulick | 271/103 |

*Primary Examiner*—Richard A. Schacher
*Attorney, Agent, or Firm*—Michael J. Striker

[57] ABSTRACT

A device for holding down sheets which are stacked on a support has a vertical cylinder mounted above the support and provided with a piston and a piston rod extending from the piston through and to the outside of the cylinder where it carries a sheet-engaging member which exerts pressure on sheets resting on the support. A pair of conduits communicates with the cylinder chambers above and below the piston and a valve is provided which can either connect both conduits with a channel supplying compressed air or which can connect the conduit for the lower chamber with a suction channel. The positive or negative pressure in the respective conduits can be regulated.

11 Claims, 1 Drawing Figure

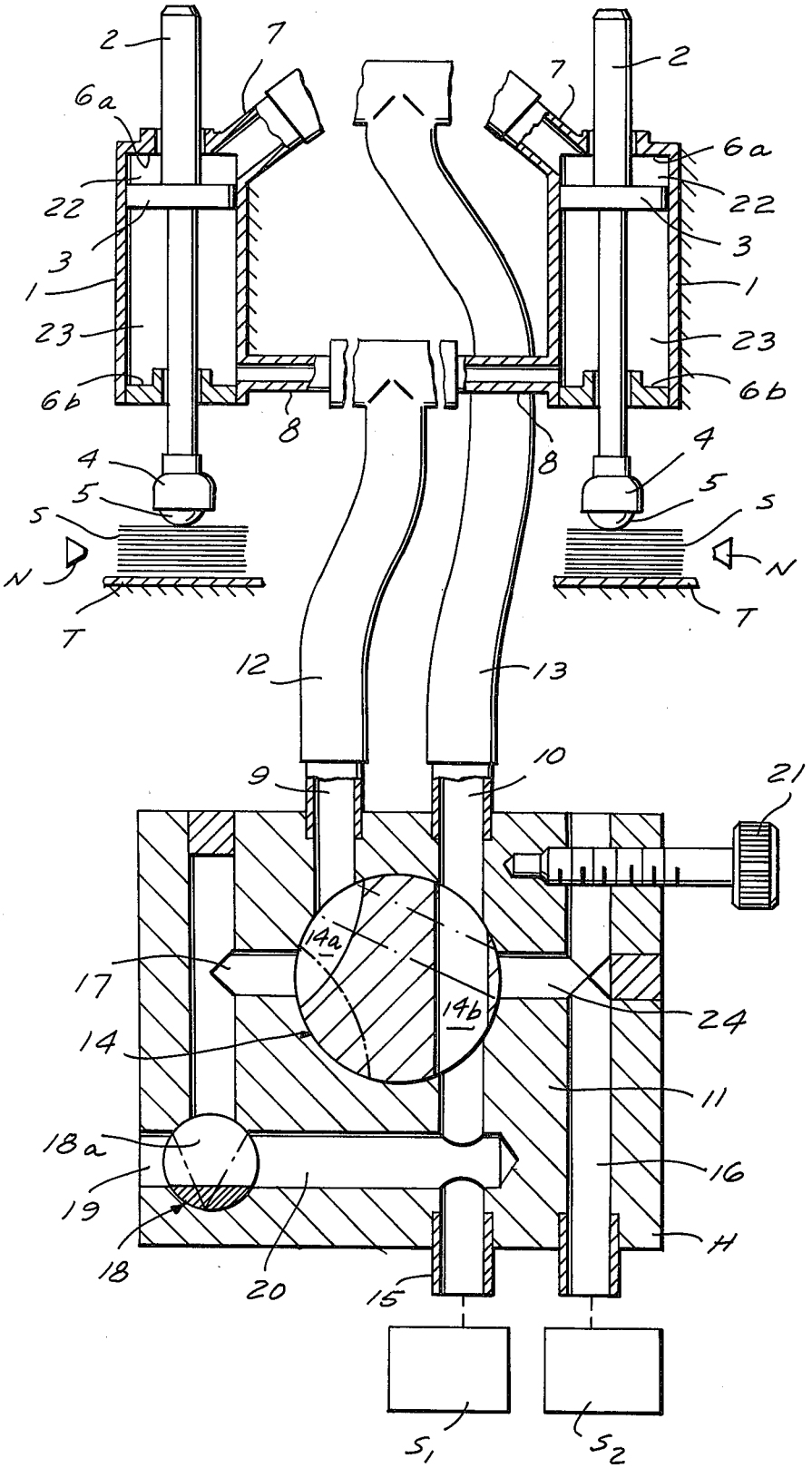
2
7
6a
22
3
1
23
6b
8
4
5
S
N
T
12
13
9
10
21
14a
14b
17
14
24
11
18a
19
18
20
15
16
H
S1
S2

SHEET-HANDLING APPARATUS

This application is a continuation-in-part application of my application Ser. No. 771,797, filed Feb. 24, 1977, and now abandoned, entitled "SHEET HOLD-DOWN FOR SHEET FEEDERS".

BACKGROUND OF THE INVENTION

This invention relates to sheet-handling apparatus, and more particularly to a device for holding down sheets which are stacked on a support.

In many types of sheet-handling apparatus, for example in printing apparatus or other types of equipment, sheets must be individually supplied to a working station from a stack of sheets. Stacked sheets, however, have a tendency to adhere to one another and in order to overcome this and to assume the feeding of only single sheets to the working station, it is known to "loosen up" the stack by blowing air between the stacked sheets. This does separate the sheets from one another; however, in the upper zone of the stack the sheets then start to "float" due to the air cushion between them and to shift transversely relative to each other. Because of this the edges of the vertically stacked sheets move out of vertical alignment and as soon as one or more of the sheets has moved laterally out of its proper position the apparatus will malfunction and shut down, because the working station can accept the sheets only in their proper positions.

Various arrangements have been proposed to overcome this problem.

Thus it has been suggested to provide two laterally adjacent vertical rods each carrying at its lower end a steel ball which rests under the influence of gravity on the uppermost sheet of the stack, in order to exert upon the stack a pressure which is intended to be constant and not influenced by fluctuations in the stack height. However, it has proved to be impossible to obtain and maintain an optimum pressure level in this manner.

A further proposal suggests a similar arrangement in which, however, the pressure-exerting elements are spring-loaded, i.e., are each biased by a spring against the upper sheet of the stack. The pressure exerted is adjustable by means of an adjusting mechanism for the spring. Here the pressure exerted on the sheet stack will evidently vary in dependence upon the fluctuating height of the stack; therefore, assuming that the desired pressure is the one which is exerted when the stack has its maximum height, then the pressure must be readjusted (i.e., increased) as the height of the stack decreases. This is cumbersome and never completely accurate or predictable, especially as it is almost impossible — certainly within economically feasible expenditures — to produce two springs having exactly identical spring characteristics or, if that is not the case, to separately readjust each spring so that it exerts exactly the same biasing force as the other spring of the arrangement.

A third proposal suggests vertically slidable rods which rest on the upper sheet of the stack and are provided with retainers into or onto which different weights can be placed. Adjustments in the contact pressure are effected by manually adding or removing respective ones of the weights. This has the disadvantage that the readjustments are time-consuming and that there are times when one rod is subjected to a greater weight than the other rod, e.g., when a weight has been removed from one rod but before the same amount of weight can be removed from the other rod.

In summary, therefore, it can be said that the prior proposals do not or not with adequate certainty assure that only single sheets are fed from a stack to a working stacking station, and that they are fed in the required orientation. Moreover, during brief machine shut-down incidents — during which the air usually continues to be blown between the sheets of the stack — these proposals cannot assure that the sheets do not shift laterally since the pressure force exerted upon the stacked sheets cannot be rapidly enough increased with the manual means provided according to these proposals.

SUMMARY OF THE INVENTION

It is a general object of the invention to overcome the disadvantages of the prior art.

A more particular object is to provide an improved device of the type under discussion, which is not subject to the prior-art disadvantages.

An additional object of the invention is to provide such a device which permits proper and economical utilization of compressed air to separate the sheets of a sheet stack while preventing uncontrollable displacement of these sheets relative to one another, especially in the upper region of the stack.

A concomitant object is to provide such a device wherein the sheets of a sheet stack are held in position not by mechanical means, and wherein the pressure exerted upon them for this purpose is not influenced by fluctuations in the stack height.

Still a further object of the invention is to provide a device of the character in question wherein the pressure to be exerted upon the sheets can be readily selected in advance, e.g., in accordance with the size and/or weight and/or stiffness of the sheets and, moreover, can be readily readjusted during operation of the requirement and will at all times be uniform.

In keeping with these objects, and with others which will become apparent hereafter, one feature of the invention resides in a device for holding down (in a sheet-handling apparatus) sheets which are stacked on a support. Briefly stated, the novel device may comprise an upright cylinder mounted above the support and containing a slidable piston which defines with the cylinder an upper and a lower cylinder chamber and a piston rod extending from the piston through the lower cylinder chamber and having an end portion adapted to exert pressure upon sheets on the support; first and second conduit means communicating with the upper and the lower cylinder chamber, respectively; a suction channel and a compressed-gas channel; valve means for selectively connecting the respective conduit means with one or the other of the channels; and regulating means for regulating the pressure prevailing in the conduit means and cylinder chambers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a partly sectioned diagrammatic view illustrating an embodiment of the invention.

DESCRIPTION OF THE PREFERRED EMBODIMENTS

In the FIGURE there are illustrated two supports (e.g., tables) T each of which supports a stack of sheets S, for example sheets of paper which are e.g., to be fed to a printing machine (not shown) by means of known devices (not shown) which form no part of the invention. It should be understood that there may, of course, be more than two of the supports T and stacks of sheets S, or that only a single one of each may be provided.

The devices for feeding the sheets S to the working station (e.g., the above-mentioned printing machine) successively remove the respectively uppermost sheet S from each stack. To assure that no withdrawn sheet has a subjacent sheet clinging to it, it is conventional practice to blow compressed air from laterally against the respective stack as indicated diagrammatically by the nozzles N, so that the air enters between the sheets and tends to separate them. When this is done, however, the moving cushion of air between the sheets S in the upper part of the respective stack causes these sheets — which do not have a weight acting on them as do the sheets in the lower part of the stack — to "float" and to shift transversely relative to one another.

Since this is undesirable, because it causes the sheets to move out of their proper feeding positions and results in machine shut-down, the earlier-described prior-art hold-down devices have been proposed. However, for the reasons explained previously, these devices are not satisfactory.

This is why the device according to the present invention is proposed.

As shown in the drawing, the device according to the present invention is provided for each support T and stack of sheets S with a vertically oriented fluid-operated cylinder 1 which is mounted above the respective stack of sheets S. Each cylinder 1 slidably accommodates a piston 3 which subdivides its interior into an upper cylinder chamber 22 and a lower cylinder chamber 23. Rigidly connected to each piston 3 is a piston rod 2 which extends through the chamber 23 and out of the lower end of the cylinder 1; the lower end portion of each piston rod carries a holder 4 in or on which there is mounted a member having a convex sheet-engaging surface, in the present instance a (preferably freely turnably held) spherical member 5. Each piston rod 2 also has an upper portion extending from piston 3 through the chamber 22 and out of the upper end of the cylinder 1. This upper portion serves to stabilize the piston 3 (i.e., prevent it from tilting) but, in addition, has the purpose of converting the piston into a differential piston. That is to say, the diameter of the upper portion of the piston rod is larger than the diameter of the lower portion of the piston rod by a factor which is so selected that the resulting differential in the upper and lower piston surfaces exposed to pressure fluid compensates for the weight of the elements 4 and 5.

A pair of conduits 7 communicates with the cylinder chambers 22 adjacent the upper end faces **6*a* of the cylinders 1, and another pair of conduits 8 communicates with the chambers 23 adjacent the lower end faces 6*b*. A conduit 12 communicates with the conduits 8; a conduit 13 communicates with the conduits 7**.

The operation of the pistons 3 is controlled by a valve unit 11 having a housing H which is formed with passages (e.g., bores) 9, 10, 15, 16, 17, 20 and 24. The housing H is also formed with a cavity in which a valve member 14 is turnably received; the passages 9, 10, 15, 17 and 24 communicate with this cavity. Rotary valve member 14 may be cylindrical (e.g., elongated in direction normal to the plane of the drawing) and is provided with a peripheral cut-out **14*a* and with a bore 14*b***.

Passages 9 and 10 communicate with conduits 12 and 13, respectively. Passage 15 communicates with a diagrammatically illustrated source S1 of pressurized fluid (usually air) and passage 16 communicates with a similarly diagrammatically shown suction source S2. The sources S1 and S2 could be combined as a single source, e.g., S1 could be the pressure side and S2 could be the suction side of a blower.

Passage 20 communicates via its end portion 19 with the ambient atmosphere; similarly, the end portion **16*a* of passage 16 also communicates with the ambient atmosphere. A rotary valve member 18 provided with the illustrated fluid opening 18*a* is interposed at the juncture of passages 17 and 20, inwardly of the open end portion 19 of passage 20. A valve view 21 extends across passage 16 inwardly of the open end portion 16*a* thereof and can open communication of passage 16 with the atmosphere via end portion 16*a*, depending upon the extent to which screw 21 is threaded in or out to block the cross-section of passage 16**.

THE OPERATION

Pressurized gas or air is admitted into the upper chambers 22 via passage 15, valve member 14 (in the full-line position of the same), the passage 10, the conduit 13 and the conduits 7; similarly, pressurized gas or air is admitted into chambers 23 via passage 15, passage 20, valve member 18, passage 17, passage 9, conduit 12 and conduits 8. The fluid pressure acting in the lower chambers 23 is set by turning the valve member 18 to a desired position in which the valve member 18 allows some or all of the pressure from passage 20 to escape via end portion 19, or else a position in which it entirely prevents transmission of the pressure from passage 20 into passage 17 and hence to chambers 23. Depending upon which of these positions is chosen, the members 5 will be pressed upon the sheets S with a lesser or greater force which is precisely selectable. Evidently, when member 18 blocks transmission of pressure from passage 20 to passage 17 completely, pressure fluid will enter only into the upper chambers 22 and the members 5 will be pressed against the sheets S with the maximum possible force. If the member 18 is moved to a position in which it permits no fluid to escape via 19 and fully communicates passage 20 with passage 17, the pressure in chambers 23 will be equal to the pressure in chambers 22, i.e., the pressures will neutralize each other and the elements 5 will not be pressed against sheets S. If the member 18 communicates passages 20 and 17 but also permits some of the pressure fluid to escape via 19, the pressure in chambers 23 will be lower than the pressure in chambers 22 by a factor which will vary in dependence upon the amount of fluid that is allowed to vent to atmosphere; correspondingly, the pressure exerted by member 5 on sheets S will be selectable at will.

In the event of a machine shut-down, i.e., when the working station (e.g., printing machine) is shut down for any purpose and for whatever duration, it is desired to firmly fix the upper sheets S against shifting under the influence of air issuing from nozzles N; as previously explained, at least in the case of short-time shut-downs the air flow from nozzles N usually continues. When such a shut-down occurs the sheet-feeding device (not shown) is usually automatically shut down also; the present invention proposes that the valve member 14 can be so connected (in a manner known per se) to the control for the sheet-feeding device that a shut-down of that device results automatically in turning of the valve member 14 to the broken-line position in which it interrupts the supply of pressure fluid from passage 15 to the passages 9 and 10. Instead, the valve member 14 now connects the passage 9 with the suction passages 16, 24 via the bore **14*b* so that suction is applied to the chambers 23, causing the pistons 3 to move downwardly and the members 5 to be firmly pressed against the sheets S. The force with which the members 5 are pressed against the sheets S can be regulated by using the screw 21 to allow more or less (nor none) communication between suction passage 16** and the atmosphere.

Since it is desirable to be able to reproduce the various settings whenever needed, the members 18 and 21 may each be associated with a scale (not shown) relative to which they turn and from which their respective setting may be read at a glance.

If desired, the conduits 12 and 13 could each be connected to a pressure-indicating gauge, or they could be connected with one another via a differential-pressure gauge. Either of these solutions would permit the pressure in these conduits — and, if the dials of the gauges are appropriately calibrated, the pressure exerted by the members 5 upon the sheets S — to be read directly off the gauges. Member 14 could be manually turnable; member 18 might be slidable instead of turnable.

The invention assures that the pressure exerted upon the sheets S is always uniform throughout the entire operation, i.e., irrespective of fluctuations in the height of the stack or stacks of sheets S. The pressure can be selected in accordance with the particular type of sheets used and taking into account the pressure of air issuing from the nozzles N. If, as illustrated, more than one stack of sheets is to be controlled, the invention also assures that each stack is subjected to a pressure which is identical to the pressure exerted upon the other stack.

It will be understood that each of the elements described above, or two or more together, may also find a useful application in other types of devices differing from the types described above.

While the invention has been illustrated and described as embodied in a device, it is not intended to be limited to the details shown, since various modifications and structural changes may be made without departing in any way from the spirit of the prevent invention.

Without further anlysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a sheet-handling apparatus, a device for holding down sheets which are stacked on a support, comprising an upright cylinder mounted above said support and containing a slidable piston which defines with said cylinder an upper and a lower cylinder chamber and a piston rod extending from said piston through said lower cylinder chamber and having an end portion adapted to exert pressure upon sheets on said support; first and second conduit means communicating with said upper and said lower cylinder chamber, respectively; a suction channel and a compressed-gas channel; valve means for selectively connecting the respective conduit means with one or the other of said channels; and regulating means for regulating the pressure prevailing in said conduit means and cylinder chambers.

2. A device as defined in claim 1, wherein said piston is a differential piston.

3. A device as defined in claim 1; further comprising a pressure element on said end portion of said piston rod for contacting the sheets and exerting pressure on the same; and wherein said piston is a differential piston having a piston surface exposed in said lower cylinder chamber which has a larger surface area than a corresponding piston surface exposed in said upper cylinder chamber, so as to compensate for the weight of said pressure element acting upon said piston.

4. A device as defined in claim 3, wherein said piston rod includes a section extending from said piston through said upper chamber and having a diameter greater than the diameter of said piston rod extending through said lower chamber.

5. A device as defined in claim 1, wherein said valve means comprises a valve block formed with passages which communicate with said channels and conduit means, respectively.

6. A device as defined in claim 5, said valve means further comprising a valve body mounted in said valve block and being removable between a first position in which it connects both of said conduit means with said compressed-gas channel and a second position in which it connects only said second conduit means with said suction channel.

7. A device as defined in claim 5, said passages comprising first passages communicating with said compressed-gas channel and second passages communicating with said suction channel; and wherein said regulating means comprises regulating elements interposed in said first and second passages, respectively, and operative for regulating the pressure therein.

8. A device as defined in claim 7, wherein each of said regulating elements is operative for connecting the associated passages to a selectable extent with the ambient atmosphere.

9. A device as defined in claim 8, wherein each of said regulating elements is displaceable to a plurality of positions relative to a calibrated dial.

10. A device as defined in claim 1; further comprising a holder mounted on said end portion of said piston rod and a pressure-exerting member carried by said holder and having a convex sheet-contacting surface.

11. A device as defined in claim 10, wherein said pressure-exerting member is a spherical member.

* * * * *